US010028893B2

(12) United States Patent
Kane et al.

(10) Patent No.: US 10,028,893 B2
(45) Date of Patent: Jul. 24, 2018

(54) OSTOMY PUMP SYSTEM AND RELATED METHODS OF USE AND MANUFACTURE

(71) Applicant: University of Virginia Patent Foundation, Charlottesville, VA (US)

(72) Inventors: Bartholomew J. Kane, Charlottesville, VA (US); Eileen S. Cadel, Lawrence, KS (US); Natalie A. Powers, Chesapeake, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 26 days.

(21) Appl. No.: 14/743,484

(22) Filed: Jun. 18, 2015

(65) Prior Publication Data

US 2015/0367111 A1 Dec. 24, 2015

Related U.S. Application Data

(60) Provisional application No. 62/013,666, filed on Jun. 18, 2014.

(51) Int. Cl.
*A61J 15/00* (2006.01)

(52) U.S. Cl.
CPC ..... *A61J 15/0049* (2013.01); *A61J 15/0076* (2015.05)

(58) Field of Classification Search
CPC .... A61F 5/44–5/449; A61F 2205/4402; A61F 2205/4415; A61F 2205/4455; A61F 2205/4483; A61F 2205/4486; A61F 2205/4495; A61F 2205/563; A61J 15/0049; A61J 15/0076
See application file for complete search history.

(56) References Cited

U.S. PATENT DOCUMENTS 3,830,235 A 8/1974 Marsan
3,937,224 A * 2/1976 Uecker ..... A61F 5/445 604/101.05
4,350,785 A 9/1982 Habib
5,569,216 A * 10/1996 Kim ..... A61F 2/0013 600/29

(Continued)

FOREIGN PATENT DOCUMENTS

WO WO 88/03818 A1 6/1988
WO WO 2004/062537 A1 7/2004

OTHER PUBLICATIONS

Schafer et al. Continuous extracorporeal stool-transport system, a new and economical procedure for transitory short-bowel syndrome in prematures and newborns, Pediatr. Surg. Int. (1997) 12, 73-75.*

(Continued)

*Primary Examiner* — Benjamin Klein
(74) *Attorney, Agent, or Firm* — Robert J. Decker

(57) ABSTRACT

A device for refeeding bowel content of a subject configured to cover a proximal ostomy of a subject and a distal member configured to cover a distal ostomy of a subject. The device may include a bowel lumen member configured to carry bowel contents between the proximal ostomy and the distal ostomy. A method for refeeding bowel content of a subject by disposing a bowel lumen member between a proximal ostomy and distal ostomy, wherein the bowel member is configured to carry bowel contents between the proximal ostomy and the distal ostomy.

12 Claims, 5 Drawing Sheets

(56) References Cited

U.S. PATENT DOCUMENTS

| | | | | |
|---|---|---|---|---|
| 5,738,661 | A * | 4/1998 | Larice | A61F 5/442 604/180 |
| 8,343,120 | B2 | 1/2013 | Smith | |
| 2013/0053802 | A1 | 2/2013 | Maidl | |
| 2013/0244935 | A1 | 9/2013 | Besner | |
| 2013/0303763 | A1 | 11/2013 | Gershon | |
| 2014/0046283 | A1 | 2/2014 | Bird | |
| 2014/0207147 | A1 | 7/2014 | Rosenberg | |
| 2014/0249494 | A1 | 9/2014 | Bird | |
| 2015/0051563 | A1 | 2/2015 | Frimel | |
| 2015/0080816 | A1 | 3/2015 | Tyree | |
| 2015/0100033 | A1 | 4/2015 | Weide | |
| 2015/0119836 | A1 | 4/2015 | Frimel | |

OTHER PUBLICATIONS

Pratap et al., Triple tube therapy, a novel enteral feeding technique for short bowel syndrome in low income countries, Journal of Pediatric Surgery (2007) 42, 470-473.*

Al-Harbi, et al., "Mucous Fistula Refeeding in Neonates With Short Bowel Syndrome", Journal of Pediatric Surgery, Jul. 1999, pp. 1100-1103, vol. 34, No. 7.

Edwards, et al., "Making the Case for Using Donor Human Milk in Vulnerable Infants", Advances in Neonatal Care, 2012, pp. 273-278, vol. 12, No. 5.

Ganapathy, et al., "Long Term Healthcare Costs of Infants Who Survived Neonatal Necrotizing Enterocolitis: A Retrospective Longitudinal Study Among Infants Enrolled in Texas Medicaid", BMC Pediatrics, 2013, 11 pages, vol. 13, No. 127.

Gardner, et al., "A Case Study Utilizing an Enteral Refeeding Technique in a Premature Infant with Short Bowel Syndrome", Advances in Neonatal Care, Dec. 2003, pp. 258-271, Vo. 3, No. 6.

Holzer, et al., "Tachykinin NK1 and NK2 receptor-mediated control of peristaltic propulsion in the guinea-pig small intestine in vitro", Neuropharmacology, Jan. 1998, pp. 131-138, vol. 37, No. 1.

Kalantzi, et al., "Characterization of the Human Upper Gastrointestinal Contents Under Conditions Simulating Bioavailability/Bioequivalence Studies", Pharmaceutical Research, Jan. 2006, pp. 165-176, vol. 23, No. 1.

Lin, et al., "Necrotising enterocolitis", Lancet, Oct. 7, 2006, pp. 1271-1283, vol. 368.

Medicaid Benefits: Medical Equipment and Supplies: The Kaiser Family Foundation, 2012, 7 pages, at http://kff.org/medicaid/state-indicator/medical-equipment-and-supplies/.

Pataki, et al., "Recycling of bowel content: The importance of the right timing", Journal of Pediatric Surgery, 2013, pp. 579-584, vol. 48.

* cited by examiner

OSTOMY PUMP SYSTEM AND RELATED METHODS OF USE AND MANUFACTURE

CROSS-REFERENCE TO RELATED APPLICATIONS

The present application claims benefit of priority under 35 U.S.C. § 119(e) from U.S. Provisional Application Ser. No. 62/013,666, filed Jun. 18, 2004, entitled "OstoPump System and Related Methods of Use and Manufacture;" the disclosure of which is hereby incorporated by reference herein in its entirety.

BACKGROUND

Infants with necrotizing enterocolitis (NEC) are born at a distinct disadvantage: the inability to absorb nutrients naturally due to a necrotic bowel. Though the causes remain unknown, the methods for treating it are inconsistent, timely, and expensive both for families and hospitals [See 1]. Current standards of care include antibiotic treatment and removal of the necrotic portions of the bowel. If surgical treatment is necessary, ostomies are created and infants are put on intravenous nutrition until their bowel has healed and reanastomosis can occur [See 2]. However, intravenous nutrition has significant debilitating long-term effects that lengthen and complicate the healing process [See 3]. Surgical NEC occurs in a population of 3,500 patients annually in the United States.

Overview

By designing various embodiments of the present invention ostomy refeeding system that connects the two ostomies, the infant can resume enteral feeding, as opposed to expensive intravenous nutrition [See 4]. By using an aspect of an embodiment of the present invention device, hospitals can save, for example, at least $2,400 per patient for providing nutritional support alone.

Currently, no devices or universal protocols exist that allow clinical staff to cleanly insert bowel contents for refeeding. An aspect of an embodiment of the present invention refeeding system (whereby one or more embodiments or portions of an embodiment may be referred to as an "OstoPump") is that, among other things, creates a temporary artificial bowel that is external from the body and connects the two ostomies, expanding on the current standard of care. Some advantages of this are that such an external device of the various embodiments of the present invention shall have less rigorous biocompatibility constraints and that they are able to utilize existing technologies for managing ostomy wound care.

An aspect of an embodiment of the present invention solution (method and system) is that, among other things, it will not only provide the tools needed to prevent leakage and backflow, but will also include a validated protocol for implementing the solution into the Neonatal Intensive Care Unit (NICU) workflow.

An aspect of an embodiment of the present invention solution is that, among other things, it will help to create a uniform approach to refeeding so that it may be practiced successfully in multiple health centers. By implementing an aspect of an embodiment of the present invention solution, patients can resume enteral feeding, heal more quickly, and be discharged sooner, reducing costs for both the hospitals and families [See 4, 5].

The Food and Drug Administration (FDA) provides alternative paths for devices—that may be applicable to an embodiment of the present invention device—targeting underserved populations. The patient population of infants with NEC is about 1 to 3 of every 1,000 live births. However, only 30% of NEC patients require surgical intervention, so the patient population that an embodiment of the present invention solution (device and method) would be serving is approximately 3,500 patients annually [See 6]. Because the annual patient population is under 4,000, the present inventors can file for a Humanitarian Device Exemption (HDE) to classify various embodiments of the present invention (e.g., a model or type of OstoPump) as a Humanitarian Use Device (HUD) [See 7].

An aspect of an embodiment of the present invention may be provided to hospitals and NICUs. Moreover, if an embodiment of the present invention is provided to consumers, for example, it may include the device and means to train consumer on its use with the new protocol. Various embodiments of the present invention (e.g., a model or type of OstoPump) may be sold as one solution per patient that will include sufficient materials to refeed for the recovery period.

An aspect of an embodiment of the present invention provides, but not limited thereto, an anchoring cone device (and related method) that may include a funnel or the like embedded in the cone. The bottom may be hollow to allow space for the stoma and/or ostomy and collect any backflow of bowel contents. Flanges are used to adhere the device to the skin. The flange may serve as a retention member.

An aspect of an embodiment of the present invention provides, but not limited thereto, a temporary artificial intestine that may include a single multilumen balloon catheter that connects the two ostomies to allow for autonomous flow of bowel contents. Anchoring cones or the like (other shaped covers) are used over each ostomy and/or stoma to, among other things, stabilize the system.

Necrotizing Enterocolitis

Current standard of care for infants with surgical NEC relies on intravenous nutrition [See 1]. There is currently no solution to recycle contents from a proximal ostomy to a distal ostomy, so potentially viable bowel contents are drained and discarded. In addition to being costly, other complications with total parenteral nutrition (TPN) include liver disease and anticoagulant disorders [See 3]. Physicians often order refeeding during the recovery period, but methods vary depending on clinical staff. When ordered to refeed, nurses do not have the designated tools, training, or methods. Additionally, the present inventors have determined that the most common method of refeeding is inserting a syringe or a catheter into the distal ostomy; however the present inventors submit that it is not successful because there is no way to anchor it into the anatomy. This lack of protocol and dedicated tools often leads to failure and clinicians that then resort to 100% intravenous nutrition as opposed to successfully refeeding.

An aspect of an embodiment of the present invention provides, but not limited thereto, a device for refeeding bowel content of a subject. The device may comprise: a proximal member configured to cover a proximal ostomy of a subject; a distal member configured to cover a distal ostomy of a subject; a bowel lumen member having a proximal end and a distal end. The proximal end of the bowel lumen is disposed at (or adjacent or proximal to) the proximal member and the distal end of the bowel lumen is disposed at (or adjacent or proximal to) the distal member. The bowel member is configured to carry bowel contents between the proximal ostomy and the distal ostomy. The device may further comprises: a proximal balloon configured to be disposed in the bowel respective to the proximal ostomy; a distal balloon configured to be disposed in the bowel respective to the distal ostomy; a proximal inflation lumen configured to inflate the proximal balloon so as to engage and contact a circumferential areal of a proximal bowel; and a distal inflation lumen configured to inflate the distal balloon so as to engage and contact a circumferential areal of a distal bowel.

An aspect of an embodiment of the present invention provides, but not limited thereto, a method for refeeding bowel content of a subject. The method may comprise: covering a proximal ostomy of a subject; covering a distal ostomy of a subject; disposing a bowel lumen member between the proximal ostomy and distal ostomy, wherein the bowel member is configured to carry bowel contents between the proximal ostomy and the distal ostomy. The method may comprises disposing a proximal balloon in the bowel of the subject respective to the proximal ostomy; disposing a distal balloon in the bowel of the subject respective to the distal ostomy; inflating the proximal balloon so as to engage and contact a circumferential areal of a proximal bowel; and inflating the distal balloon so as to engage and contact a circumferential areal of a distal bowel.

An aspect of an embodiment of the present invention provides, but not limited thereto, a device for refeeding bowel content of a subject. The device may comprises: a proximal member configured to cover a proximal ostomy of a subject; a distal member configured to cover a distal ostomy of a subject; and a bowel lumen member having a proximal end and a distal end. The proximal end of the bowel lumen is disposed at (or adjacent or proximal to) the proximal member and the distal end of the bowel lumen is disposed at (or proximal or adjacent to) the distal member, and wherein the bowel member is configured to carry bowel contents between the proximal ostomy and the distal ostomy.

An aspect of an embodiment of the present invention provides, but not limited thereto, a method for refeeding bowel content of a subject. The method may comprise: covering a proximal ostomy of a subject; covering a distal ostomy of a subject; and disposing a bowel lumen member between the proximal ostomy and distal ostomy, wherein the bowel member is configured to carry bowel contents between the proximal ostomy and the distal ostomy.

An aspect of an embodiment of the present invention provides, but not limited thereto, a device for refeeding bowel content of a subject configured to cover a proximal ostomy (or cover at least in part and/or anchor to the proximal ostomy) of a subject and/or a distal member configured to cover a distal ostomy (or cover at least in part and/or anchor to the distal ostomy) of the subject. The device may include a bowel lumen member configured to carry bowel contents between the proximal ostomy and the distal ostomy (or to other location, equipment or destination; or between other locations, sets of equipment, and destinations). An aspect of an embodiment of the present invention provides, but not limited thereto, a method for refeeding bowel content of a subject by disposing a bowel lumen member between a proximal ostomy and distal ostomy, wherein the bowel member is configured to carry bowel contents between the proximal ostomy and the distal ostomy (or to other location, equipment or destination; or between other locations, sets of equipment, and destinations).

These and other objects, along with advantages and features of various aspects of embodiments of the invention disclosed herein, will be made more apparent from the description, drawings and claims that follow.

BRIEF DESCRIPTION OF THE DRAWINGS

The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTION OF EXEMPLARY EMBODIMENTS OF THE PRESENT INVENTION

Figure 1:
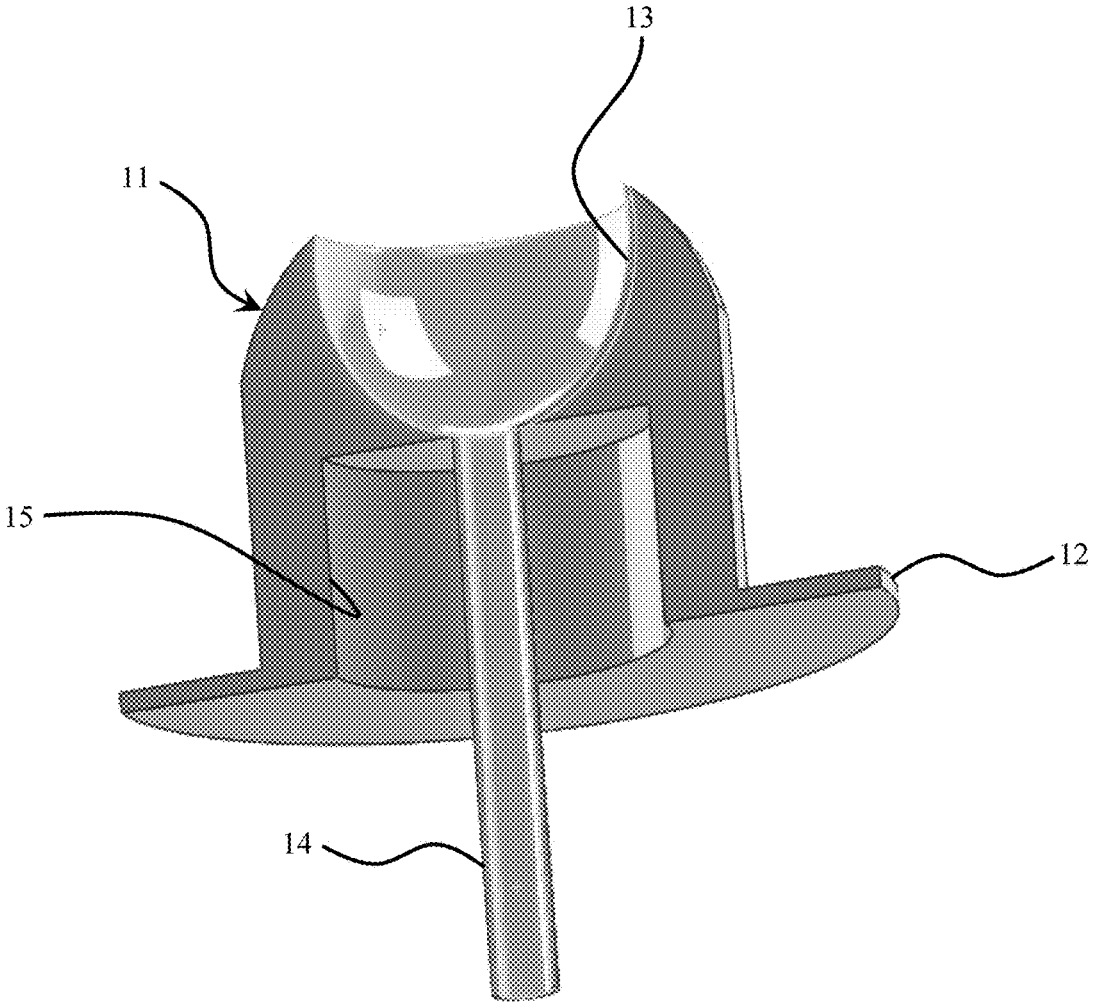
FIG. 1 schematically provides a cross-sectional view of an embodiment of portions of the cover.

An ostomy is an opening, for example often in the abdomen below the belly button, that is put there surgically in the treatment of a medical condition. Sometimes an ostomy may be in the neck, such as in the treatment of throat or neck cancer. A stoma refers to the small portion of intestine that pokes through the ostomy. It should be appreciated that an ostomy may be any location on a subject. It should be appreciated that various embodiments may be applicable to either the ostomy or stoma, as well as both the ostomy and stoma.

OstoPump

An aspect of an embodiment of the present invention solution (method and system) provides clinical staff the dedicated tools and protocol to successfully refeed infants with ostomies as a result of NEC. An aspect of an embodiment of the present invention (such as part of or entire OstoPump) may include a means to anchor the system into the ostomy, connecting tubes between the ostomies, and a peristaltic pump to move contents in accordance with natural intestinal contractions. By creating an autonomous flow for contents between ostomies, an aspect of an embodiment of the present invention provides an ease of use for clinical staff to refeed infants. An aspect of an embodiment of the present invention device (e.g., a type of OstoPump model or portions thereof) allows infants post-bowel resection surgery to be placed on oral feeding in place of or in addition to TPN. This alternative method of providing nutrition is more cost effective and less harmful than the current standard of care. By creating a universal protocol, an aspect of an embodiment of the present invention device (e.g., type of OstoPump model or portions thereof), or related method, can be easily integrated into the current workflow in NICUs across the United States.

The present inventors note that a peristaltic pump (or other type of pump or advancing mechanism) is disclosed as an aspect of an embodiment of the present invention method and component to move bowel contents between ostomies. However, alternative embodiments may also use other methods or components to transfer the bowel contents between the ostomies. For example, a stop-cock (or other type of valve or the like) in the catheter (or in communication with the catheter) may be used that collects the contents in a ostomy bag between the ostomies. Then a nurse (or practitioner/user) could manually use a syringe to insert the contents through the stop-cock back into the distal portion of the catheter.

Another alternative embodiment includes having the bowel contents collect in an ostomy bag (similar to what is currently done in the clinic) and use just the distal connection with a syringe to move the bowel contents. Therefore, it should be appreciated that the present invention system is not limited to the anchoring system, connecting tubes, and a peristaltic pump.

Accordingly, the present inventors submit that there are various components and techniques of embodiments of the present invention whereby the contents can be moved between ostomies.

An embodiment of the present invention that utilizes the OstoPump would utilize a peristaltic pump (or other type of pumping or advancing mechanism) because it means nurses or users do not have to take time to manually refeed the infants or other subjects (e.g., children, teenagers or adults).

OstoPump: Design

Referring to FIG. 1, an aspect of an embodiment of the present invention approach to refeeding bowel contents from the proximal ostomy to the distal ostomy may have, among others, two components. The first focuses on the distal anchoring system. The distal anchoring system may include a hollow cover 11, such as a cone, that may have a flange 12, which may include an adhesive wafer (or other fastening material or mechanism) for adhering to the skin 2 of the subject (not shown) surrounding the stoma and/or ostomy (not shown), a passage 13 that may be a hollow funnel enclosed in the hollow cover 11, such as a cone or the like, that goes over the stoma and/or ostomy (not shown), and a balloon catheter (not shown) that that goes through a hole in the top of the hollow cover 11 and into the intestine (not shown). The flange may serve as a retention member. This disclosed embodiment component is advantageous because, among other things, it uses a hollow cover 11, such as a cone, and balloon catheter (not shown) to anchor the device. The cover forces the catheter to be perpendicular to the abdomen, utilizing forces of gravity to aid in the insertion of the bowel contents. The cover (or cone) also acts as a rigid anchor to reduce leakage of bowel contents while the passage 13, such as a funnel, will contain any backflow. The balloon (not shown) may be designed to serve as a plug to prevent backflow and leakage of bowel contents. The cover 11 may have a chamber 15 to collect any leaked back flow from the patient. The passage 13 may be a funnel design having an elongate member 14, such as a stem, disposed in the subject.

Figure 2:
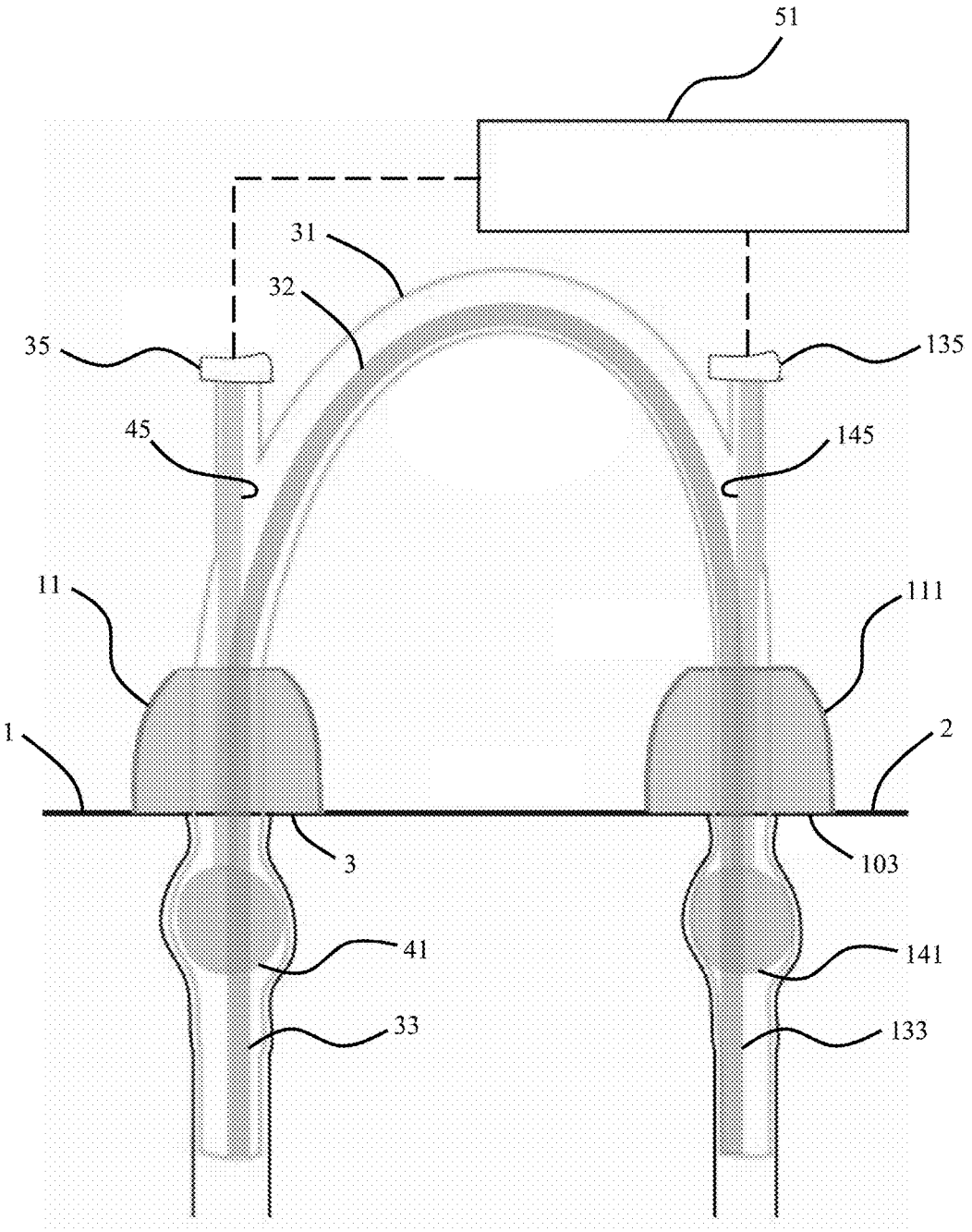
FIG. 2 schematically provides a side view of an embodiment of the device used for refeeding bowel content of a subject.

Referring to FIG. 2, the second component to an aspect of an embodiment of the present invention refeeding approach is providing, but not limited thereto, a temporary external artificial intestine to be used between the two ostomies during the patient's recovery. This will allow for autonomous flow of the bowel contents, a novel refeeding approach. This eliminates stagnant contents that may lead to infection while reducing the amount of nurses' hours used to refeed [See 8].

Still referring to FIG. 2, an embodiment of the device used for refeeding bowel content of a subject 1 may include a proximal member 11 (such as a cover or the like) configured to cover a proximal ostomy 3 of a subject 1 as generally shown at the skin 2 or surface of the like. The device may comprise a distal member 111 (such as a cover) configured to cover a distal ostomy 103 of a subject 1. Further, the device may include a bowel lumen member 32 having a proximal end 33 and a distal end 133, whereby said proximal end 33 of said bowel lumen 32 is disposed at or near said proximal member 11 and said distal end 133 of said bowel lumen 32 is disposed at or near said distal member 111. The bowel member is configured to carry bowel contents between the proximal ostomy 3 and the distal ostomy 103. The device may further include a proximal balloon 41 configured to be disposed in the bowel respective to the proximal ostomy 3 and a distal balloon 141 configured to be disposed in the bowel respective to the distal ostomy 103. Further, the device may include a proximal inflation lumen 45 configured to inflate said proximal balloon 41 so as to engage and contact a circumferential areal of the proximal bowel of the subject. The device may include a distal inflation lumen 145 configured to inflate said distal balloon 141 so as to engage and contact a circumferential areal of a distal bowel of the subject.

Still referring to FIG. 2, the lumens may be separate from one another or disposed within a multilumen structure 31. A pump 51 is provided in communication with a proximal port 35 and a distal port 135.

OstoPump: Prototype

Figures 3A, 3B, 3C, 4A, 4B, 4C, 5A, 5B, 5C:
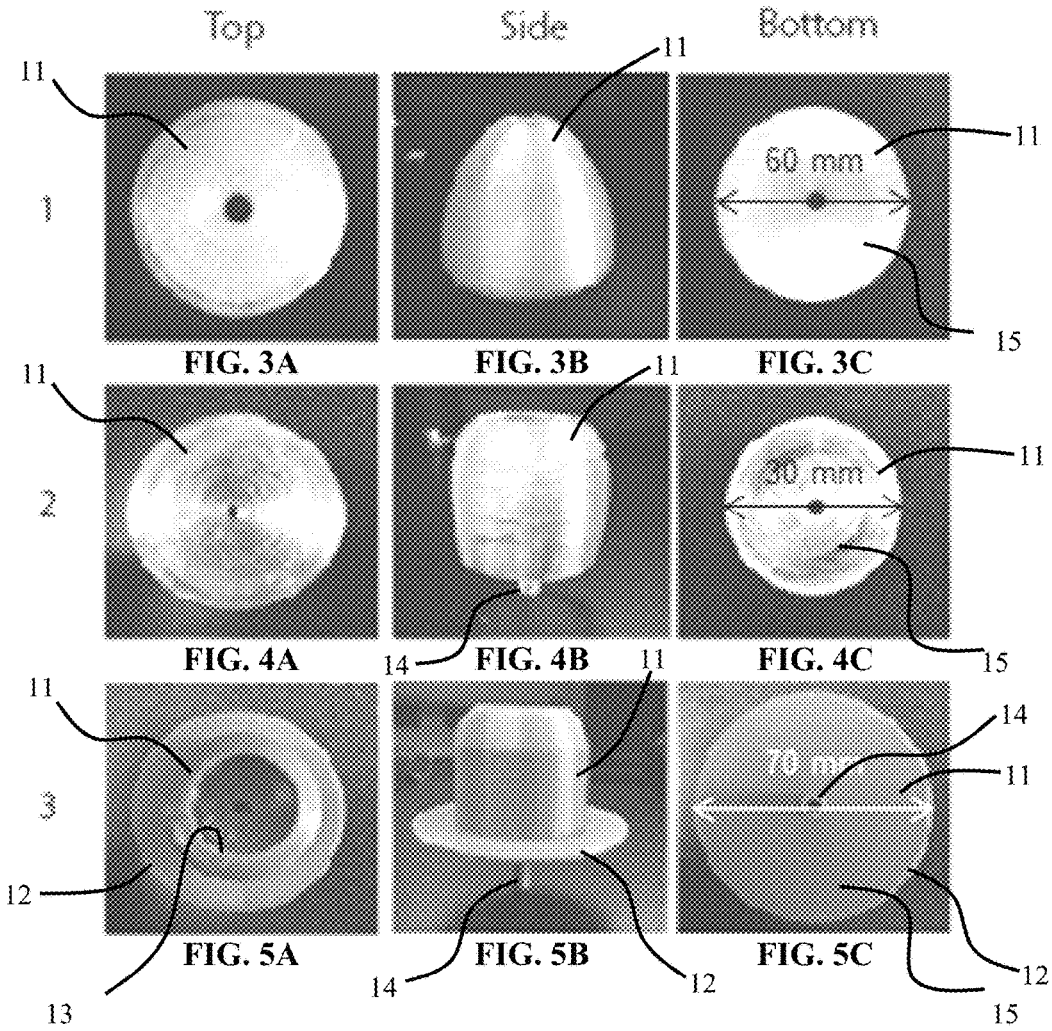
FIGS. 3A, 4A, and 5A provides a photographic depiction of a top view of the respective embodiments of a cover.
FIGS. 3B, 4B, and 5B provides photographic depiction of a side view of the respective embodiments of the cover.
FIGS. 3C, 4C, and 5C provides a photographic depiction of a bottom view of the respective embodiments of the cover.

Referring to FIGS. 3-5, FIGS. 3-5 provide a photographic depiction of an aspect of an embodiment of the present invention that may include, among other things, hollow cover 11, such as a cone, over the ostomy (not shown). FIGS. 3A, 4A, and 5A provides a top view of the respective embodiments. FIGS. 3B, 4B, and 5B provides a side view of the respective embodiments. FIGS. 3C, 4C, and 5C provides a bottom view of the respective embodiments. An aspect of an embodiment of the present invention may include, among other things, the passage 13 (as shown in FIG. 5A), such as a funnel within the cover 11 (e.g., cone or the like). The end 14 (e.g., stem or elongated member) of the passage (e.g., funnel) will go into the intestine (not shown), through which either a catheter can be inserted for more rigidity or contents can be flowed from the bowl of the funnel. This design will aid in providing more rigidity to the system and also maintain the inevitable backflow by allowing space for contents to collect and slowly drain into the distal ostomy. The cone or cover 11 may have a bottom 15 as shown in FIGS. 3C, 4C, and 5C. The bottom may be configured to span entirely across the width of the cover or partially across the width of the cover (or any degree thereof). Alternatively, the bottom may be minimal such the it's area is defined by the perimeter or circumference of the bottom edge of the cover. The cone or cover 11 may have a flange 12 as shown in FIGS. 5A-5C.

It should be appreciated that the cover 11 (or portions of the related components) as discussed herein may take on all shapes along the entire continual geometric spectrum of manipulation of x, y and z planes to provide and meet the anatomical and structural demands, operational requirements, and surgical needs—for example to cover the ostomy and/or stoma (or adhere to or anchor to the ostomy and/or stoma or adjacent areas of the subject).

An aspect of an embodiment of the present invention solution (method and system) is a simple yet elegant way to address the problem of refeeding surgical NEC patients. The present inventors have determined that backflow of contents out of the ostomy and/or stoma may be inevitable. Based on this information, the present inventors are moving forward with an approach (but not limited thereto) with the cone embedded with a funnel because, among other things, it better accommodates the inevitable backflow.

The present inventors further note, that there may still be progress to be made in developing and further testing the device before implementation in the clinic. Animal models have shown promise that the device will work and so the present inventors next step would be to acquire Institutional Review Board (IRB) approval and protocol. With an IRB protocol, the present inventors can test various embodiments of the device on infants with ostomies to determine its efficacy for anchoring and transporting contents. Safety has already been established with previous studies that use a catheter for inserting bowel contents into an ostomy [See 4, 11].

Currently, no devices exist that allow clinical staff to cleanly insert bowel contents for refeeding.

Moreover, it should be appreciated that an aspect of an embodiment of the present invention device may be specifically designed to make it cleaner and easier to use or practice heretofore, thus reducing the amount of manual labor required by nurses to implement the solution.

By pursuing a HDE, the present inventors could have an aspect of an embodiment of the present invention device approved for marketing without proof of effectiveness or clinical data that a Premarket Notification (PMN) or Premarket Approval (PMA) would require.

The present inventors demonstrated that various aspects of embodiments of the present invention (such as a model or portion of a model of the OstoPump) is at least as safe and effective as the Foley balloon catheter and the adhesive ostomy bag.

An aspect of an embodiment of the present invention provides, but not limited thereto, a novel and nonobvious solution for infants with Necrotizing Enterocolitis.

The cone portion of an aspect of an embodiment of the present invention device may be manufactured using injection molding with Polylactic Acid (PLA) or other available manufacturing methods. The present inventors' estimates take into account the length, width, and height of our device along with its projected area, the area of any holes, the total part volume, the complexity of the part, and quality and tolerance of the manufacturing process.

An aspect of an embodiment of the present invention solution (method and system) will not only provide the tools needed to prevent or mitigate leakage and backflow, but will also include a proposed protocol for implementing the solution.

Developing a means to provide enteral nutrition to infants can greatly reduce the stress and economic load on health systems caused by intravenous nutritional drug shortages. Accordingly, an aspect of an embodiment of the present invention, such as an OstoPump model type or portions thereof, will not only save families and hospitals money, but will also contribute to a more efficient healing time and hospital stay with fewer debilitating side-effects.

It should be appreciated that the device and related components discussed herein may take on all shapes along the entire continual geometric spectrum of manipulation of x, y and z planes to provide and meet the anatomical, environmental, and structural demands and operational requirements. Moreover, locations and alignments of the various components may vary as desired or required.

It should be appreciated that as discussed herein, a subject may be a human or any animal. It should be appreciated that an animal may be a variety of any applicable type, including, but not limited thereto, mammal, veterinarian animal, livestock animal or pet type animal, etc. As an example, the animal may be a laboratory animal specifically selected to have certain characteristics similar to human (e.g. rat, dog, pig, monkey), etc. It should be appreciated that the subject may be any applicable human patient, for example.

It should be appreciated that aspects of the present invention may have a variety of sizes, contours, shapes, compositions and materials as desired or required.

EXAMPLES

Practice of an aspect of an embodiment (or embodiments) of the invention will be still more fully understood from the following examples and experimental results, which are presented herein for illustration only and should not be construed as limiting the invention in any way.

Experimental Results and Examples Set No. 1

Figure 6:
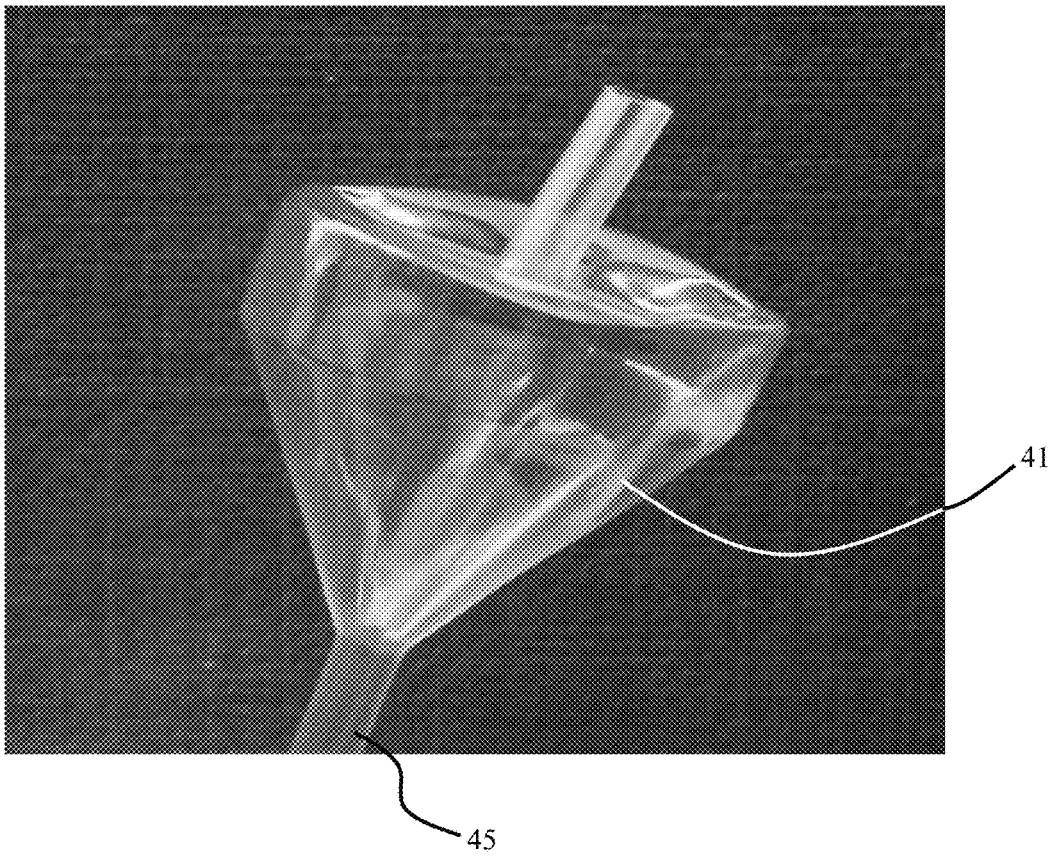
FIG. 6 provides a photographic depiction of a perspective view of a catheter balloon and related components.

Referring to FIG. 6, FIG. 6 provides a photographic depiction of a perspective view of a prototype that has been developed to utilize and test different balloon shapes. The nominal balloon 41 may take advantage of the smaller, more rigid diameter of the stoma and/or ostomy as compared to the larger, more elastic diameter of the intestine. When performing in vitro tests on model intestines, the Foley naturally inflated into a sphere. However when inflated inside the intestine, it was elongated due to mucosal tissue lining the anatomy. Also shown is a balloon catheter 45 (e.g., proximal balloon catheter) in communication with the balloon 41 (e.g., proximal balloon). It should be appreciated that a distal balloon catheter 145 may be in communication with a distal balloon 141. It should be appreciated that the balloon catheters and related balloon catheter components discussed herein may can take on all shapes along the entire continual geometric spectrum of manipulation of x, y and z planes to provide and meet the anatomical and structural demands, operational and requirements. Size and shape of the balloons during the various stages of deployment (non-deployed, partially deployed, and fully deployed, for example) could also be manipulated by varying the compliance of the balloon walls and inflation/expansion pressure.

Moreover, the present inventors have prototyped iterations of the cover (such as a cone) for the distal ostomy connection. The assembled solution has been used for the in vitro testing of our design. As a next step, the present inventors plan on investigating pumps (such as peristaltic pumps) that would connect the proximal to the distal ostomy to allow for autonomous flow of bowel contents. It should be appreciated that a wide variety of pump types may be implemented and utilized.

Experimental Results and Examples Set Nos. 2 and 3

OstoPump: Feasibility Tests

To research effectiveness, the present inventors ran two feasibility experiments. The first was to verify that bowel contents would sufficiently flow through our device and into the distal portion on the intestine. This was accomplished by creating an in vitro model of the abdomen and ostomy using rat intestines. The present inventors then attached an embodiment of the device to the ostomy and used a Foley catheter to insert the bowel contents. The device was successful in flowing contents through a Foley catheter into the intestine. The present inventors noted observed that there was a small amount of backflow. However, this was contained by the present invention device and did not leak onto the model abdominal wall.

The second experiment was to verify that OstoPump could be sufficiently anchored without harming the anatomy. To do this, the present inventors inserted a Foley catheter into rat intestines and inflated the balloon with volumes of water ranging from 0.0 cc to 1.5 cc. The present inventors then used an Instron machine to collect the tensile force data required to pull the inflated balloon from the intestine. There was a significant difference in the amount of force required to remove a balloon inflated to 0.5 cc compared to 1.0 cc (p value=0.009). Observations also showed that inflating the balloon to the minimum volume, 0.5 cc, was sufficient in anchoring the catheter into the intestine. It also showed that small increases in the volume had significant effects on the force required to remove the catheter (See FIG. 7).

Figure 7:
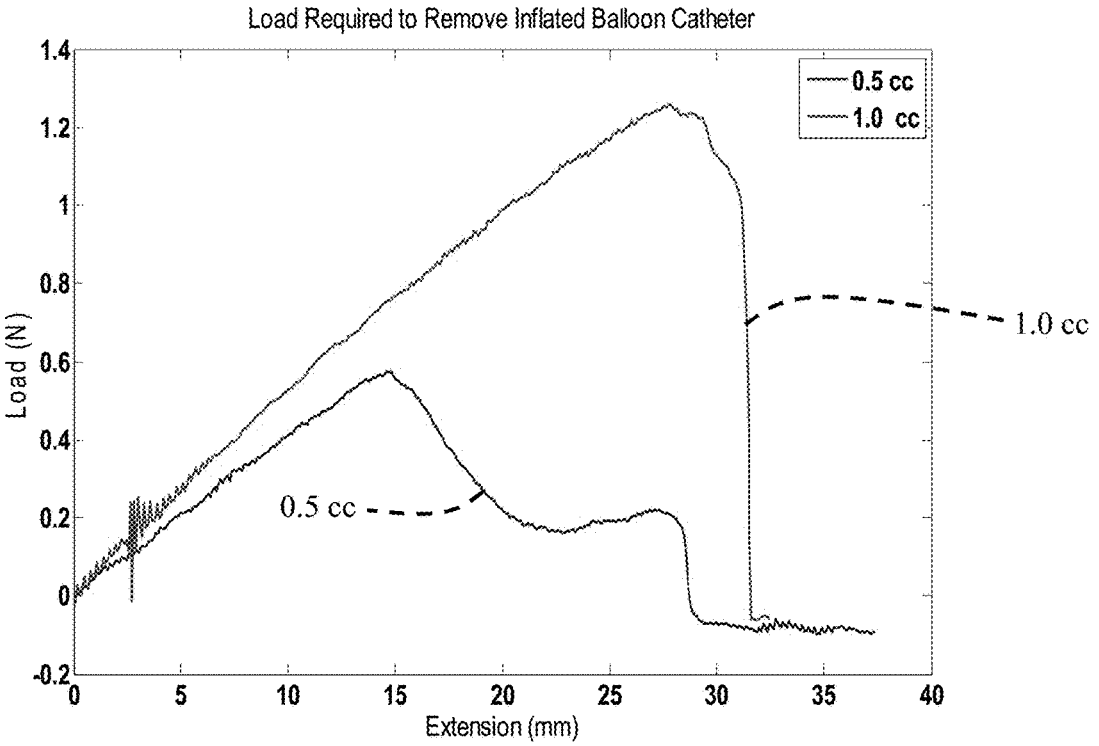
FIG. 7 provides a graphical representation of load required to remove an inflated balloon catheter.

Experiments on model rat intestines show success in inflating a balloon catheter inside the anatomy to prevent accidental removal. A goal of an embodiment of the present invention, among others, is to provide the lowest volume needed to anchor the catheter in order to prevent damaging the mucosal layer of the intestine. Experiments have been run on balloons inflated to 0.5 cc and 1.0 cc and show promise in succeeding with this aim; see, for example, FIG. 7. FIG. 7 provides a graphical representation of load required to remove an inflated balloon catheter. The present inventors note that there was a significantly larger load (p=0.009) required to remove catheters inflated with 1.0 cc of water compared to 0.5 cc. The graph depicts curves for two selected samples of rat intestines.

To verify that contents would flow in the closed loop catheter system, the present inventors needed to confirm that the peristaltic pressure exerted by the intestine would be greater than the opposing capillary pressure inside the catheter. To determine this, the present inventors calculated the capillary pressure in an 8 French Foley catheter (Formula 1).

capillary presure = Formula 1

$$\frac{4*\gamma}{d} = \frac{\left(4*0.0424\frac{\mathrm{N}}{\mathrm{m}}\right)}{0.00267\ \mathrm{m}} = 63.52\frac{\mathrm{N}}{\mathrm{m}^2} \text{ or } 0.469\ \mathrm{mmHg}$$

Capilllary Presure.

Capillary pressure is equal to 4 times the surface tension of contents in the small intestine ($Y$) divided by the inner diameter of an 8 $Fr$ catheter ($d$).

Capillary pressure opposes peristaltic pressure.

In order for flow to occur, peristaltic pressure must be greater than capillary pressure.

The result was 0.469 mmHg, using 0.4242 N/m as the surface tension for infant formula [See 9]. Peristaltic pressure in a small mammal is known to be 0.65 mmHg±0.02[10]. Though these are approximations, they show that it is likely that peristaltic pressure is greater than the capillary pressure in the catheter. Therefore, bowel contents will flow in a closed loop catheter model. However, since the present inventors note that the flow rate of bowel contents can vary or be unknown, the present inventors will continue to investigate the use of a pump system to aid movement.

Experimental Results and Examples Set No. 4

An aspect of an embodiment of the present invention may include a price per unit of a Foley catheter is $1.49 [See 22] and for a peristaltic pump is it $55.00 [See 23]. For each patient, an aspect of an embodiment (e.g., a model of an OstoPump or at least portions thereof) will include 50 cones, 40 catheters, and one peristaltic pump, with production costs totaling $350.00. This price is reasonable because our solution is much less expensive than TPN which is currently used ($68,600 on average per patient).

Table 1 provides related manufacturing costs for 10,000 cones (pertaining to style for an exemplary, non-limiting, embodiment).

TABLE 1

Manufacturing Costs for 10,000 Cones. Costs include materials, production, and tooling.

| Manufacturing for 10,000 cones | Cost (in USD) |
|---|---|
| Materials | $10,122 |
| Production | $ 6,927 |
| Tooling | $25,733 |
| Total | $42,782 |

ADDITIONAL EXAMPLES

Example 1

A device for refeeding bowel content of a subject. The device comprises: a proximal member configured to cover a proximal ostomy of a subject; a distal member configured to cover a distal ostomy of a subject; a bowel lumen member having a proximal end and a distal end. The proximal end of the bowel lumen is disposed at (or adjacent or proximal to) the proximal member and the distal end of the bowel lumen is disposed at (or adjacent or proximal to) the distal member. The bowel member is configured to carry bowel contents between the proximal ostomy and the distal ostomy. The device further comprises: a proximal balloon configured to be disposed in the bowel respective to the proximal ostomy; a distal balloon configured to be disposed in the bowel respective to the distal ostomy; a proximal inflation lumen configured to inflate the proximal balloon so as to engage and contact a circumferential areal of a proximal bowel; and a distal inflation lumen configured to inflate the distal balloon so as to engage and contact a circumferential areal of a distal bowel.

Example 2

The device of example 1, wherein the proximal member comprises a proximal member passage configured to allow the passage of the proximal end of the bowel lumen and proximal inflation lumen there through.

Example 3

The device of example 1 (as well as subject matter of example 2), wherein the distal member comprises a distal member passage configured to allow the passage of the proximal end of the bowel lumen and proximal inflation lumen there through.

Example 4

The device of example 1 (as well as subject matter of one or more of any combination of examples 2-3), further comprising: a pump configured to move the bowel contents between the proximal ostomy and the distal ostomy.

Example 5

The device of example 4 (as well as subject matter of one or more of any combination of examples 2-4), wherein the pump is configured to move bowel contents in accordance with natural intestinal contractions of a subject.

Example 6

The device of claim 1 (as well as subject matter of one or more of any combination of examples 2-5), further comprising a retention member for retaining the proximal member to the subject.

Example 7

The device of example 1 (as well as subject matter of one or more of any combination of examples 2-6), further comprising a retention member for retaining the distal member to the subject.

Example 8

The device of example 1 (as well as subject matter of one or more of any combination of examples 2-7), wherein the proximal member comprises a backflow chamber configured to collect backflow from the subject.

Example 9

The device of example 1 (as well as subject matter of one or more of any combination of examples 2-8), wherein the distal member comprises a backflow chamber configured to collect backflow from the subject.

Example 10

The device of example 1, wherein the proximal member and/or distal member having a conical shape, rectangular shape, polygonal shape, semi-spherical shape, or semi-elliptical shape.

Example 11

The device of example 1 (as well as subject matter of one or more of any combination of examples 2-10), wherein the proximal balloon is configured to allow for the bowel lumen to pass there through proximal balloon so as to provide as proximal member passage.

Example 12

The device of example 11 (as well as subject matter of one or more of any combination of examples 2-11), wherein the proximal member passage of the proximal member having a funnel shape.

Example 13

The device of example 1 (as well as subject matter of one or more of any combination of examples 2-12), wherein the distal balloon is configured to allow for the bowel lumen to pass there through distal balloon so as to provide as distal member passage.

Example 14

The device of example 13 (as well as subject matter of one or more of any combination of examples 2-13), wherein the distal member passage of the distal member having a funnel shape.

Example 15

The device of example 1 (as well as subject matter of one or more of any combination of examples 2-13), wherein: a) the proximal member having a flare shaped portion configured to make contact with the subject adjacent to the proximal ostium; b) the distal member having a flare shaped portion configured to make contact with the subject adjacent to the distal ostomy, or c) the proximal member having a flare shaped portion configured to make contact with the subject adjacent to the proximal ostium and the distal member having a flare shaped portion configured to make contact with the subject adjacent to the distal ostomy.

Example 16

The device of example 1 (as well as subject matter of one or more of any combination of examples 2-15), further comprising: an advancing means for manually or automatically moving the bowel contents between the proximal ostomy and the distal ostomy.

Example 17

The device of example 16 (as well as subject matter of one or more of any combination of examples 2-15), wherein the advancing means moves bowel contents in accordance with natural intestinal contractions of a subject.

Example 18

A method for refeeding bowel content of a subject. The method comprises: covering a proximal ostomy of a subject; covering a distal ostomy of a subject; disposing a bowel lumen member between the proximal ostomy and distal ostomy, wherein the bowel member is configured to carry bowel contents between the proximal ostomy and the distal ostomy. The method comprises disposing a proximal balloon in the bowel of the subject respective to the proximal ostomy; disposing a distal balloon in the bowel of the subject respective to the distal ostomy; inflating the proximal balloon so as to engage and contact a circumferential areal of a proximal bowel; and inflating the distal balloon so as to engage and contact a circumferential areal of a distal bowel.

Example 19

The method of example 18, wherein the method comprises passing the bowel lumen and proximal inflation lumen through the proximal member.

Example 20

The method of example 18 (as well as subject matter of example 19), wherein the method comprises passing the bowel lumen and proximal inflation lumen through the distal member.

Example 21

The method of example 18 (as well as subject matter of one or more of any combination of examples 19-20), further comprises: pumping the bowel contents between the proximal ostomy and the distal ostomy.

Example 22

The method of example 21 (as well as subject matter of one or more of any combination of examples 19-21), wherein the pumping moves bowel contents in accordance with natural intestinal contractions of a subject.

Example 23

The method of claim 18 (as well as subject matter of one or more of any combination of examples 19-22), further comprises retaining the proximal member to the subject.

Example 24

The method of example 18 (as well as subject matter of one or more of any combination of examples 19-23), further comprises retaining the distal member to the subject.

Example 25

The method of example 18 (as well as subject matter of one or more of any combination of examples 19-24), further comprises collecting backflow from the subject using the proximal member.

Example 26

The method of example 18 (as well as subject matter of one or more of any combination of examples 19-25), further comprises collecting backflow from the subject using the distal member.

Example 27

The method of example 18 (as well as subject matter of one or more of any combination of examples 19-26), further comprises passing the bowel lumen through the proximal balloon.

Example 28

The method of example 18 (as well as subject matter of one or more of any combination of examples 19-27), further comprises passing the bowel lumen through the distal balloon.

Example 29

The method of example 18 (as well as subject matter of one or more of any combination of examples 19-28), further comprises: automatically advancing or manually advancing the bowel contents between the proximal ostomy and the distal ostomy.

Example 30

The method of example 29 (as well as subject matter of one or more of any combination of examples 19-28), wherein the advancing means moves bowel contents in accordance with natural intestinal contractions of a subject.

Example 31

A device for refeeding bowel content of a subject. The device comprises: a proximal member configured to cover a proximal ostomy of a subject; a distal member configured to cover a distal ostomy of a subject; and a bowel lumen member having a proximal end and a distal end. The proximal end of the bowel lumen is disposed at (or adjacent or proximal to) the proximal member and the distal end of the bowel lumen is disposed at (or proximal or adjacent to) the distal member, and wherein the bowel member is configured to carry bowel contents between the proximal ostomy and the distal ostomy.

Example 32

The device of example 31 (as well as subject matter of one or more of any combination of examples 2-17), further comprising: an advancing means for manually or automatically moving the bowel contents between the proximal ostomy and the distal ostomy.

Example 33

A method for refeeding bowel content of a subject. The method comprises: covering a proximal ostomy of a subject; covering a distal ostomy of a subject; and disposing a bowel lumen member between the proximal ostomy and distal ostomy, wherein the bowel member is configured to carry bowel contents between the proximal ostomy and the distal ostomy.

Example 34

The method of example 33 (as well as subject matter of one or more of any combination of examples 19-30), further comprises: automatically advancing or manually advancing the bowel contents between the proximal ostomy and the distal ostomy.

Example 35

A device for refeeding or advancing bowel content of a subject. The device comprises a member configured to at least partially cover an ostomy (including a stoma) and/or anchor to the ostomy (including stoma), wherein the cover is configured to carry bowel contents to and/or from the ostomy (including stoma).

Example 36

A method for refeeding or advancing bowel content of a subject. The method comprised at least partially covering an ostomy (including stoma) and/or anchoring to the ostomy (including stoma); and wherein the method includes carrying (advancing or moving) bowel contents to and/or from the ostomy (including stoma).

Example 37

The method of using any of the devices or its components provided in any one or more of examples 1-30, 31-32, and 35. The method of use may including utilizing any of the techniques or approaches disclosed in references 1-24 and A-H cited herein.

Example 38

The method of manufacturing any of the devices or its components provided in any one or more of examples 1-30, 31-32, and 35. The method of manufacturing may utilize any of the techniques, materials, compositions, components, approaches, devices, or systems disclosed in references 1-24 and A-H cited herein.

REFERENCES

The following patents, applications and publications as listed below and throughout this document are hereby incorporated by reference in their entirety herein (and which are not admitted to be prior art with respect to the present invention by inclusion in this section).

1. Lin, P. W. & Stoll, B. J. Necrotising enterocolitis. *Lancet* 368, 1271-1283 (2006).
2. Board, A. D. A. M. E. Necrotizing enterocolitis. (2011). at <http://www.ncbi.nlm.nih.gov/pubmedhealth/PMH0002133/>
3. Total Parenteral Nutrition. at <http://www.chp.edu/CHP/tpn+intestine>
4. Al-Harbi, K., Walton, J. M., Gardner, V., Chessell, L. & Fitzgerald, P. G. Mucous fistula refeeding in neonates with short bowel syndrome. *J. Pediatr. Surg.* 34, 1100-1103 (1999).
5. Ganapathy, V., Hay, J. W., Kim, J. H., Lee, M. L. & Rechtman, D. J. Long term healthcare costs of infants who survived neonatal necrotizing enterocolitis: a retrospective longitudinal study among infants enrolled in Texas Medicaid. *BMC Pediatr.* 13, 127 (2013).
6. Tintinalli, J. E., Kelen, G. D., Stapczynski, J. S. & Physicians, A. C. of E. *Emergency Medicine: A Comprehensive Study Guide, Sixth edition*. (McGraw Hill Professional, 2003).
7. CFR—Code of Federal Regulations Title 21. at <http://www.accessdata.fda.gov/scripts/cdrh/cfdocs/cfcfr/CFRSearch.cfm?fr=814.3>
8. Pataki, I. et al. Recycling of bowel content: the importance of the right timing. *J. Pediatr. Surg.* 48, 579-584 (2013).
9. Kalantzi, L. et al. Characterization of the Human Upper Gastrointestinal Contents Under Conditions Simulating Bioavailability/Bioequivalence Studies. *Pharm. Res.* 23, 165-176 (2006).
10. Holzer, P., Lippe, I. T., Heinemann, A. & Bartho, L. Tachykinin NK1 and NK2 receptor-mediated control of peristaltic propulsion in the guinea-pig small intestine in vitro. *Neuropharmacology* 37, 131-138 (1998).
11. Smith, R. J. M. & Bird, P. Ostomy bag. (2012).
12. Habib, W. W. Protective adhesive paste for use with ostomy appliances. (1983).
13. A, M. Disposable irrigator drain with stoma cone for ostomy patients. (1974).
14. Jr, I. B. B. Stoma irrigation device. (1988).
15. May, O. J. & Smith, R. J. M. A support for an ostomy bag. (2004).
16. Besner, G. E. Methods of Treating Necrotizing Enterocolitis Using Heparin Binding Epidermal Growth Factor. (2013).
17. Gershon, M. D. & MARGOLIS, K. G. Methods and compositions for the treatment of necrotizing enterocolitis. (2013).
18. Gardner, V. A., Walton, J. M. & Chessell, L. A case study utilizing an enteral refeeding technique in a premature infant with short bowel syndrome. *Adv. Neonatal Care Off. J. Natl. Assoc. Neonatal Nurses* 3, 258-268; quiz 269-271 (2003).
19. e-CFR: TITLE 21—*Food and Drugs. Electron. Code Fed. Regul.* at <http://www.ecfr.gov/cgi-bin/text-idx?c=ecfr&tpl=/ecfrbrowse/Title21/21cfr876_main_02.tpl>
20. Medicaid Benefits: Medical Equipment and Supplies. at <http://kff.org/medicaid/state-indicator/medical-equipment-and-supplies/>
21. Cost Estimator, Injection Molding. at <http://www.custompartnet.com/estimate/injection-molding/>
22. BARDIA Silicone Elastomer Latex Foley Catheter—Sterile. *Med. Supply Depot* at <http://www.medicalsupplydepot.com/Urological-Catheters/Foley-Catheters/Bard-BARDIA-Silicone-Elastomer-Latex-Foley-Catheter-Sterile.html>
23. 200 Series Peristaltic Pump with DC Powered Motors. *Williamson Manuf. Co. Ltd.* at <http://www.williamson-shop.co.uk/200-series-with-dc-powered-motors-4371-p.asp>
24. Edwards, T. M. & Spatz, D. L. Making the case for using donor human milk in vulnerable infants. *Adv. Neonatal Care Off. J. Natl. Assoc. Neonatal Nurses* 12, 273-278; quiz 279-280 (2012).

ADDITIONAL REFERENCES

The following patents, applications and publications as listed below are hereby incorporated by reference in their entirety herein. It should be appreciated that various aspects of embodiments of the present method, system, devices, article of manufacture, computer readable medium, material, and compositions may be implemented with the following methods, systems, devices, article of manufacture, computer readable medium, materials, and compositions disclosed in the following U.S. patent applications, U.S. patents, and PCT International Patent Applications and are hereby incorporated by reference (and which are not admitted to be prior art with respect to the present invention by inclusion in this section):

A. U.S. Patent Application Publication No. US 2015/0119836 A1, Frimel, et al., "Ostomy Stoma Waste Overflow Process and Bag, Apr. 30, 2015.
B. U.S. Patent Application Publication No. US 2015/0100033 A1, Weide, et al., "Semi-Rigid Device for Sealing and Allowing Continuous Drainage of Colostomy Bags", Apr. 9, 2015.
C. U.S. Patent Application Publication No. US 2015/0080816 A1, Tyree, H., "Cleansing Kit for Colostomy Bags", Mar. 19, 2015.
D. U.S. Patent Application Publication No. US 2015/0051563 A1, Frimel, et al., "Ostomy Stoma Waste Overflow System", Feb. 19, 2015.
E. U.S. Patent Application Publication No. US 2014/0249494 A1, Bird, et al., "Attachment Mechanism for Ostomy Bags", Sep. 4, 2014.
F. U.S. Patent Application Publication No. US 2014/0207147 A1, Rosenberg, et al., "Temporary Retention Device", Jul. 24, 2014.
G. U.S. Patent Application Publication No. US 2014/0046283 A1, Bird, P., "Ostomy Bags", Feb. 13, 2014.
H. U.S. Patent Application Publication No. US 2013/0053802 A1, Maidl, et al., "Ostomy Devices", Feb. 28, 2013.

In summary, while the present invention has been described with respect to specific embodiments, many modifications, variations, alterations, substitutions, and equivalents will be apparent to those skilled in the art. The present invention is not to be limited in scope by the specific embodiment described herein. Indeed, various modifications of the present invention, in addition to those described herein, will be apparent to those of skill in the art from the foregoing description and accompanying drawings. Accordingly, the invention is to be considered as limited only by the spirit and scope of the following claims, including all modifications and equivalents.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particularly interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

We claim:

1. A device for refeeding bowel content of a subject, said device comprises:

a proximal member configured to cover a proximal ostomy of a subject;

a distal member configured to cover a distal ostomy of a subject;

a bowel lumen member having a proximal end and a distal end, said proximal end of said bowel lumen is disposed at said proximal member and said distal end of said bowel lumen is disposed at said distal member, and wherein said bowel member is configured to carry bowel contents between the proximal ostomy and the distal ostomy;

a proximal balloon configured to be disposed in the bowel respective to the proximal ostomy;

a distal balloon configured to be disposed in the bowel respective to the distal ostomy;

a proximal inflation lumen configured to inflate said proximal balloon so as to engage and contact a circumferential area of a proximal bowel;

a distal inflation lumen configured to inflate said distal balloon so as to engage and contact a circumferential area of a distal bowel;

wherein said proximal member comprises a proximal member passage configured to allow the passage of said proximal end of said bowel lumen and proximal inflation lumen there through, and said proximal balloon is configured to allow for said bowel lumen to pass there through;

wherein said distal member comprises a distal member passage configured to allow the passage of said distal end of said bowel lumen and distal inflation lumen there through, wherein said distal balloon is configured to allow for said bowel lumen to pass there through; and a multilumen structure, wherein:

said multilumen structure passes through said proximal member and configured to pass through the proximal ostomy, said multilumen structure passes through said distal member and configured to pass through the distal ostomy, said bowel lumen member passes through said multilumen structure, said proximal balloon and said distal balloon are disposed inside said multilumen structure, and said proximal inflation lumen and said distal inflation lumen passes through said multilumen structure.

2. The device of claim 1, further comprising:

a pump configured to move the bowel contents between the proximal ostomy and the distal ostomy.

3. The device of claim 1, further comprising a retention member for retaining said proximal member to the subject.

4. The device of claim 1, further comprising a retention member for retaining said distal member to the subject.

5. The device of claim 1, wherein said proximal member comprises a backflow chamber configured to collect backflow from the subject.

6. The device of claim 1, wherein said distal member comprises a backflow chamber configured to collect backflow from the subject.

7. The device of claim 1, wherein said proximal member and/or distal member having a conical shape, rectangular shape, polygonal shape, semi-spherical shape, or semi-elliptical shape.

8. The device of claim 1, wherein said proximal member passage of said proximal member having a funnel shape.

9. The device of claim 1, wherein:

said distal member passage of said distal member having a funnel shape.

10. The device of claim 1, wherein:

said proximal member having a flare shaped portion configured to make contact with the subject adjacent to the proximal ostomy; or said distal member having a flare shaped portion configured to make contact with the subject adjacent to the distal ostomy; or wherein:

said proximal member having a flare shaped portion configured to make contact with the subject adjacent to the proximal ostomy; and said distal member having a flare shaped portion configured to make contact with the subject adjacent to the distal ostomy.

11. The device of claim 1, further comprising:

an advancing means for manually or automatically moving the bowel contents between the proximal ostomy and the distal ostomy.

12. The device of claim 10, further comprising:

an advancing means for manually or automatically moving the bowel contents between the proximal ostomy and the distal ostomy.

* * * * *